United States Patent [19]

Rylewski

[11] 4,021,165

[45] May 3, 1977

[54] ROTATIVE MACHINE FOR FLUIDS WITH SPIRAL-LIKE PASSAGES AND VANE WHEELS

[76] Inventor: Eugeniusz M. Rylewski, 43 bis, Avenue du Gal Leclerc, 78470 St. Remy les Chevreuse, France

[22] Filed: Dec. 10, 1975

[21] Appl. No.: 639,628

[30] Foreign Application Priority Data

Dec. 13, 1974 France ..... 74.41257

[52] U.S. Cl. ..... 418/111; 418/183; 418/215; 418/226

[51] Int. Cl.[2] ..... F01C 1/00; F03C 3/00; F04C 1/00; F01C 19/00

[58] Field of Search ..... 418/111, 183, 215, 218, 418/226

[56] References Cited

UNITED STATES PATENTS

| | | | |
|---|---|---|---|
| 926,731 | 7/1909 | Dowling | 418/218 |
| 1,042,994 | 10/1912 | Wilson | 418/111 |
| 1,304,497 | 5/1919 | Maxam | 418/226 |
| 1,367,801 | 2/1921 | Clark | 418/226 |
| 2,090,280 | 8/1937 | Biermann | 418/218 |
| 2,436,285 | 2/1948 | Booth | 418/183 |

FOREIGN PATENTS OR APPLICATIONS

| | | | |
|---|---|---|---|
| 832,405 | 2/1952 | Germany | 418/226 |

*Primary Examiner*—John J. Vrablik
*Attorney, Agent, or Firm*—Morgan, Finnegan, Pine, Foley & Lee

[57] ABSTRACT

A rotative machine for fluids comprising a plate with spiral-like passages (stator), facing a disc (rotor) mounted for rotation relative to the stator on a common axis and carrying, on its face in front of the passages, vane wheels mounted for rotation on axes transverse to the said common axis whose vanes circulate in the passages where they form fluid compartments completed by the cooperating surfaces of the stator and of the rotor covering the passages.

In one embodiment, a rotor faces the first and second stators, respectively, and has vane wheels cooperating, by their diametrically opposite parts, simultaneously with the passages of the first and second stators between an inlet chamber and an outlet chamber. The fluid entering the machine is thus directed towards one and the other inlet chambers and the outlet chambers of the two stators are connected to a common outlet of the machine.

6 Claims, 11 Drawing Figures

Fig. 7
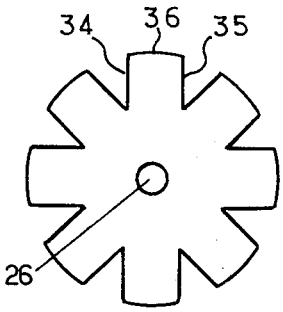
Fig. 8
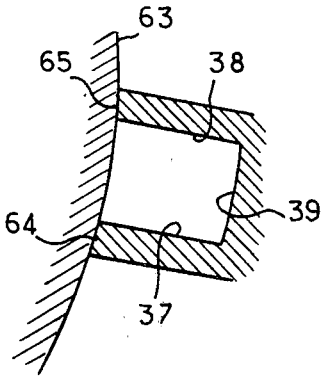
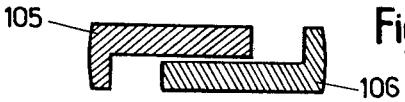
Fig. 11
Fig. 9
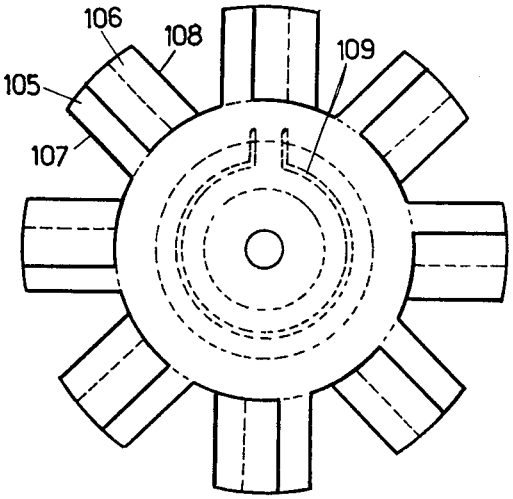
Fig. 10
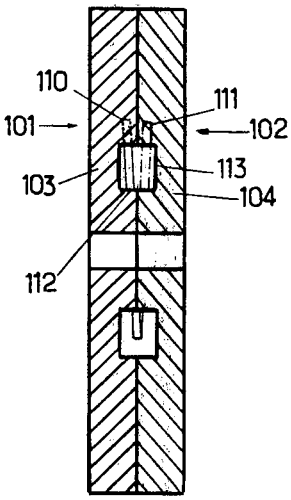

ROTATIVE MACHINE FOR FLUIDS WITH SPIRAL-LIKE PASSAGES AND VANE WHEELS

The object of the invention is a rotative machine for fluids with spiral-like passages and vane wheels.

It concerns rotative machines for fluids comprising a stator in a form of a disc, the internal face of which has spiral-like passages angularly distributed around the axis of the disc. The passages connect a central chamber with an annular chamber, and receive the vanes of vane wheels which are carried by a rotor mounted for rotation about said axis. The vanes cooperate with the fluid circulating in the passages so as to put this fluid under pressure when the machine is driven, and, on the contrary, to put the rotor into rotation when the machine operates as a motor.

Such machines are described in the Patents listed below filed in the name of the present applicant:

French Pat. No. 71.20194 filed on the June 3, 1971 for "Driving or driven machines for liquids", French Pat. No. 71.20195 filed on June 3, 1971 for "Driving or driven machines for gases", French Pat. No. 71.20196 filed on June 3, 1971 for "Gas turbine".

A machine of this type has been proposed with several stages, with one rotor placed between two stators, the cooperation of the vane wheels of the rotor with the spiral-like passages of the first stator being the first stage of the machine, the fluid leaving this first stage being carried to the second stage where its pressure is again increased (when the machine operates as a pump or a compressor) by the cooperation of the vane wheels of the rotor with the spiral-like passages of the second stator.

The object of the present invention is a machine of the type described above comprising one rotor carrying only one series of vane wheels which, on one face of the rotor, cooperate with the passages of a first stator and, on the opposite face, cooperate with the passages of a second stator. The machine is characterized by the fact that the fluid entering it is directed to a first chamber from which start the spiral-like passages of the first stator and to a second chamber from which start the spiral-like passages of the second stator, the outlet ends of the passages opposite of the inlet ends of the first stator as well as those of the second stator being connected to the common outlet chamber of the machine.

The machine having one rotor and two stators is, therefore, a machine with one stage and it delivers, in comparison with the machine with one stage proposed so far, a volume rate practically doubled for the overall dimensions of the same order and for the same rise of pressure as obtained with a machine with one stator.

Moreover, a vane wheel of the machine according to the present invention, cooperating simultaneously with the passages of the first stator and with the passages of the second stator is exposed to symmetrical efforts which put the wheel in a condition of operation which is better than that observed on the vane wheels of the machine presently known.

The invention covers also a structure where, particularly when it is utilized as a pump for liquids, the liquid under pressure in the outlet chamber is utilized to balance the thrusts exerted on the rotor.

In the following description, made as an example, reference is made to the accompanying drawing, in which:

FIG. 7 is a front view of a vane wheel;

FIG. 8 is a view similar to FIG. 3 but for another part of the machine;

FIG. 9 is a front view of a vane wheel made from several parts;

FIG. 10 is a view in section along line 10—10 of FIG. 9; and

FIG. 11 is a view in cross-section of a vane wheel according to FIGS. 9 and 10.

Figure 1:
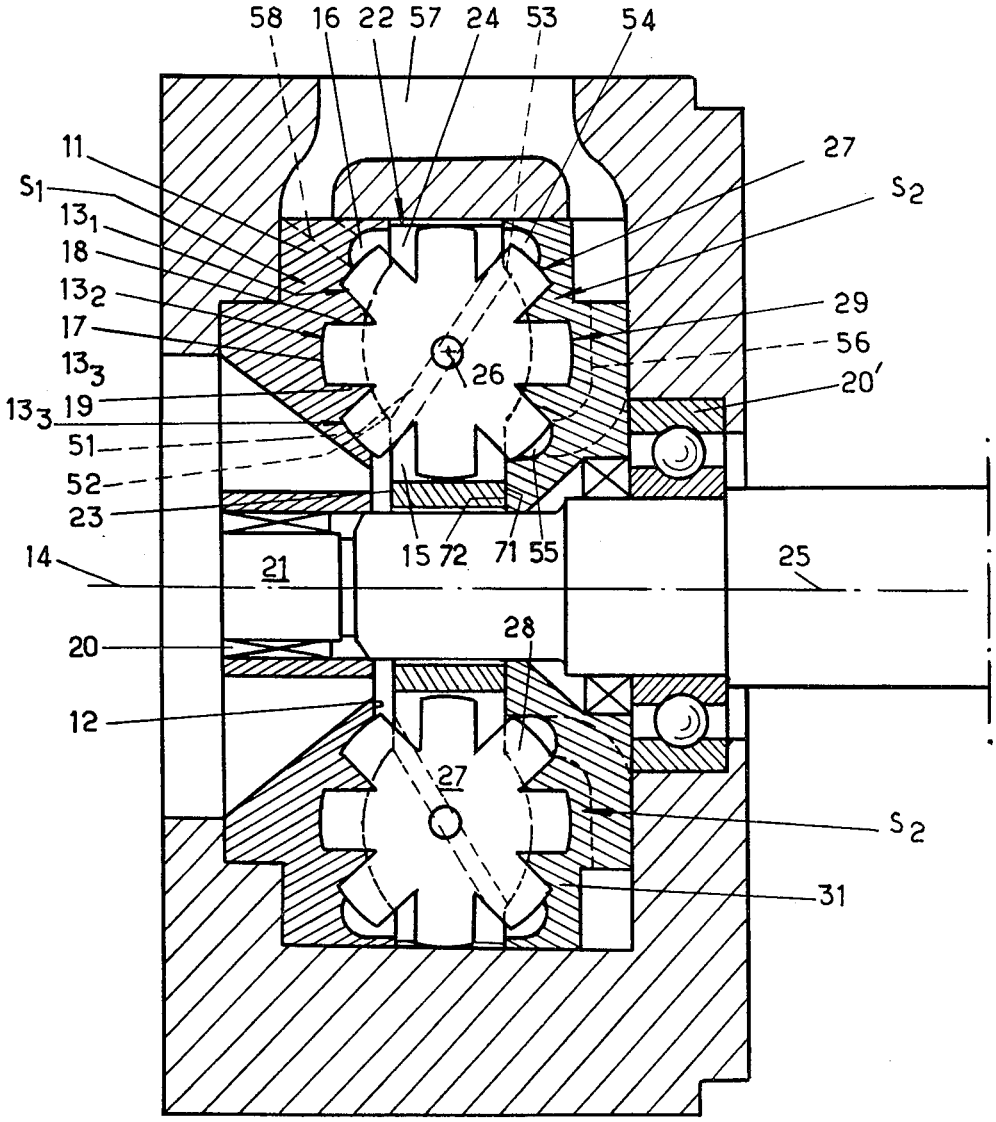
FIG. 1 is a schematic view in axial section.
Figure 2:
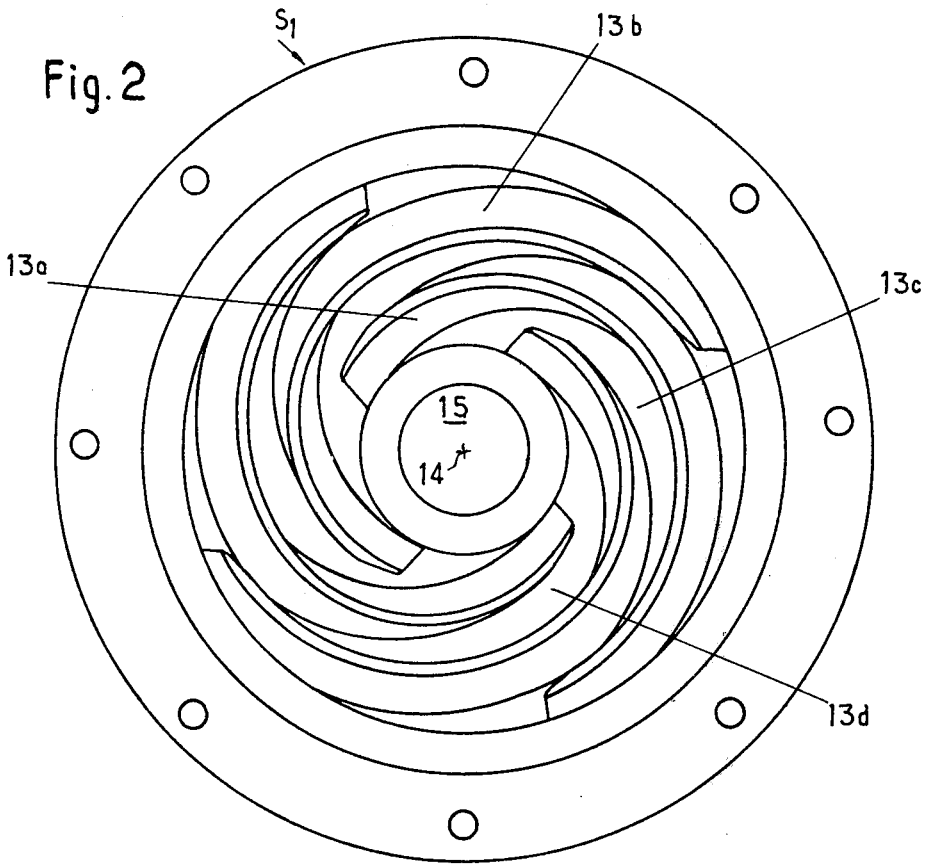
FIG. 2 is a front view of the stator.
Figure 3:
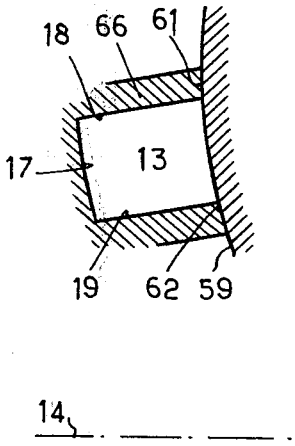
FIG. 3 is a schematic view in section of a part of the machine.
Figure 5:
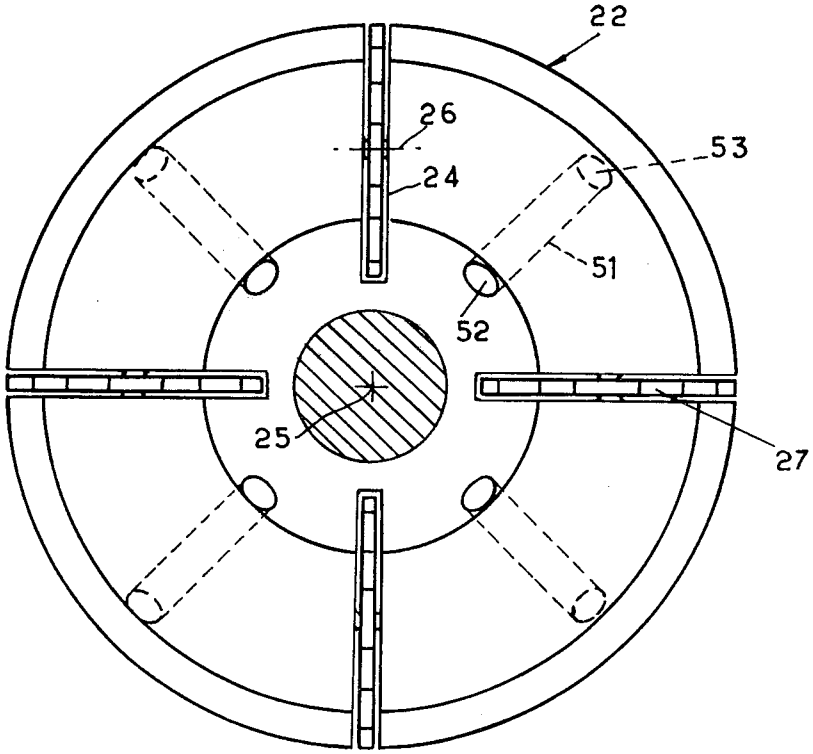
FIG. 5 is a front view of the rotor.
Figure 4:
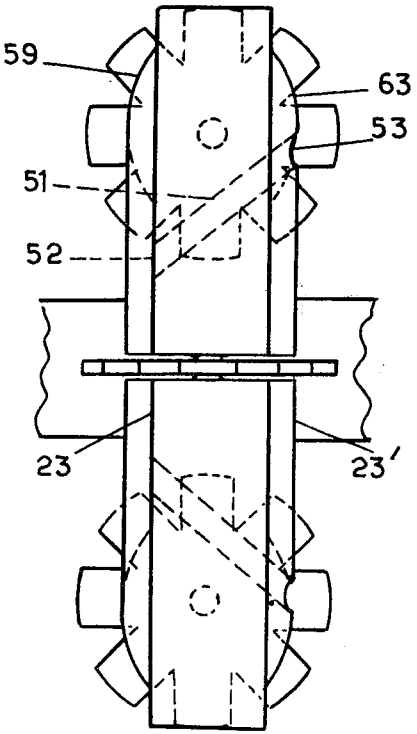
FIG. 4 is a view in elevation of the rotor.

The machine of the present invention comprises a first stator $S_1$ (FIG. 1), constituted by a disc 11, having on its face 12 the passages $13_a$, $13_b$, $13_c$, $13_d$ (FIG. 2), in the form of spirals uniformly distributed angularly around an axis 14, which start in a central chamber 15 and end in a peripheral chamber 16. These passages have, in cross-section, a form practically rectangular with a bottom 17 (FIG. 3), an external flank 18 and an internal flank 19, the latter being closer to the axis 14 then the external flank 18 when the same cross-section is considered. In the bearings 20, 20', there is housed for rotation a shaft 21 which is an integral part of the rotor 22, (FIG. 4) one face 23 of which is facing the face 12 of the disc 11. The rotor 22 has slots 24 (FIG. 5) uniformly distributed around the axis 25 of the rotor which prolongs the axis 14. Vane wheels 27 with vanes 28 are housed in these slots for rotation about the axes 26. The vanes 28 have a cross section conjugated with the cross-section of the grooves, or passages, 13.

The vane wheels 27 protrude from the face 23 of the rotor and they protrude also from the opposite face 23' of the rotor. The vanes 28 of the wheels 27 cooperate, by their portions protruding from the face 23', with the passages 29, also in the form of spirals, of the second stator $S_2$ constituted by the disc 31.

The configuration of the spiral-like passages 13 of the first stator and the configuration of the spiral-like passages 29 of the second stator are such that, during a composed movement resulting from the rotation of the rotor 22 in relation to the stators $S_1$ and $S_2$ and from the rotation of the vane wheels 27 around their own axes 26 (FIG. 6), the internal and external flanks respectively 19 and 18, as well as the bottom 17 of the passages 13 of the stator $S_1$, are conjugated with the surfaces defined by the lateral sides 34 and 35 (FIG. 7) and also by the frontal side 36 of the vanes 28 and the internal flank 37 (FIG. 8), the external flank 38 and the bottom 39 of the passages 29 of the second stator $S_2$ are similarly conjugated with the surfaces defined by the lateral sides 35 and 34 and the frontal side 36 of the vanes 28.

In the rotor 22 there are thru-conduits 51 placed in the angular spaces between the slots 24. One orifice 52 of these conduits emerges into a central chamber 15 while the opposite orifice 53 emerges into an annular chamber 54, arranged between the periphery of the front face comprising the passages of the second stator $S_2$ and the rotor 22 and from where start the peripheral ends of the spiral-like passages 29 of the second stator $S_2$.

The stator $S_2$ also has a central chamber 55 to which extend the internal ends of the passages 29. The chamber 55 is connected, through a conduit 56 drilled through the stator $S_2$, with a discharge chamber 57 to which is also connected a conduit 58 made in the first stator whose other end communicates with the annular space 16.

The stator $S_2$ has a shoulder 71 with which cooperates a conjugated shoulder 72 of the face 23′ of the rotor 22.

The conduits for the circulation of the fluid made by the passages 13 of the first stator $S_1$ are completed by a surface 59 on the face 23 of the rotor 22 which cooperates slidingly with the top walls 61 and 62 of the passages 13.

In the same way, the conduits for the circulation of the fluid made by the passages 29 of the second stator $S_2$ are completed by a surface 63 on the face 23′ of the rotor 22 which cooperates slidingly with the top walls 64 and 65, of the conjugated form, of the passages 29.

The operation is the following:

When, for example, the machine is to operate as a pump, the fluid to be compressed is admitted to the chamber 15. The rotor 22 is put into rotation by a motor connected to the shaft 21 in the direction which tends to drive the vane wheel 27 represented at the upper part of the FIG. 1, behind the plane of the figure.

The cooperation of the vanes 28 with the passages 13 pushes the fluid present in the passages and the fluid which leaves the peripheral ends of the passages 13, then reaches, under pressure, the space 16 from which it is evacuated through the conduit 58 to the outlet chamber 57 of the machine.

Simultaneously, the fluid flowing into the machine reaches, through the conduits 51 drilled through the rotor 22, the annular chamber 54 of the second stator $S_2$ and the cooperation of the vanes of the vane wheels 27 with the passages 29 on the stator $S_2$ discharges the fluid, this time in a centripetal movement, while increasing the pressure up to the ends of the passages 29, to a central chamber 55 from where, through conduit 56, it reaches the outlet chamber 57.

Figure 6:
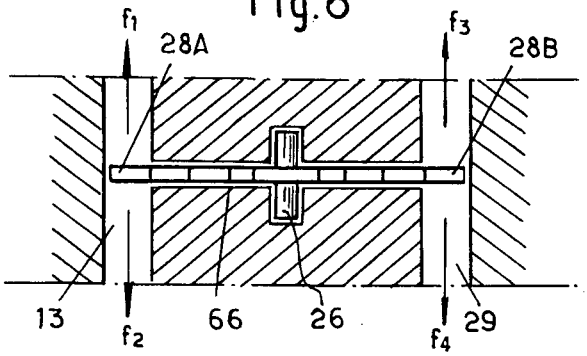
FIG. 6 is a schematic view developed and in section of a part of the machine.

In such a machine, a vane wheel 27 cooperates, as shown on FIG. 6, which is a view in section through the axis of the vane wheel while supposing the passages developed, through the vane $28_A$ with the fluid present in a passage 13 of the first stator $S_1$, discharging the said fluid in the direction shown by the arrow $f_1$, the reaction of the said fluid on the vane being in the opposite direction shown by the arrow $f_2$.

Through a diametrally opposite vane $28_B$, the same wheel 27, by a cooperation of the said vane with a passage 29 of the stator $S_2$, discharges the fluid present in the said passage in the direction of the arrow $f_3$, and the vane receives, therefore, from the fluid, a reaction in the direction of the arrow $f_4$.

The reactions of the fluid on the diametrally opposite vanes $28_A$ and $28_B$ shown by $f_2$ and $f_4$ have for consequence that the working surface of the body of the wheel 27 is the face 66 of the slot 24 in which the wheel 27 is housed. The friction of the wheel 27 against the face 66 of the slot 24 can be reduced by the interposition of a lubricant.

The wheel 27 is, moreover, subjected, by the frontal sides $36_A$ and $36_B$ of the diametrally opposite vanes $28_A$ and $28_B$ to the pressures of the fluid perpendicularly to the axis 33 of the wheel and, which, therefore, balance each other.

The forces of the pressure on the rotor due to the circulation of the fluid in the passages 13 and 29 respectively, increase progressively in the passages 13 when one considers sections more and more away from the axis 14–25 while said forces decrease in the passages 29 when one considers sections more and more closer to the said axis. In other words, the pressure of the circulating fluid increases in the passage 13 between inlet 15 and outlet 16 on the one side 23 of the rotor and, similarly, the pressure of the fluid increases in the passage 29 between inlet 54 and outlet 55 on the other side 23′ of the rotor. However, the fluid in passage 13 acts against a surface area whose distance away from axis 14–25 continually increases while the fluid in passage 29 acts against a surface area whose distance from axis 14–25 continually decreases. This results in a thrust bigger on the face 23 of the rotor than on the face 23′.

The surfaces of cooperation of the shoulders 71 of the stator and 72 of the rotor situated in a zone of high pressures are chosen big enough to compensate for the aforesaid difference of thrusts on the faces 23, 23′ of the rotor, so that an equality of thrusts, exerting on each face of the rotor, is obtained.

The invention provides for the use of vanes in several parts, so that the lateral sides of the vanes be pushed by spring means against the external and internal faces of the passages. Advantageously, one vane wheel is composed of two or more plates put together, each of which has portions of the vanes. Spring means are utilized to move the opposite sides of a vane apart. A form of a structure of such a vane wheel is shown on FIGS. 9 and 11. It comprises two vane plates 101 and 102, the bodies 103 and 104 of which are joined side by side with a possibility to rotate one in relation to the other. Each of the plates comprises portions of the vane, 105 and 106 respectively, joined side by side. The two portions constituting a vane, including the longitudinal sides 107 and 108, are at a variable distance owing to the action of the spring means 109, one extremity 110 of which is secured to the body 103 at its other extremity 111 being secured to the body 104. The spring 109 tends to rotate the plates one in relation to the other in the direction which assures a maximum width to each vane. The spring means 109 is housed in annular cavities 112 and 113 made, facing each other, in the bodies 103 and 104.

Not only such a vane wheel in two parts contributes to a better sealing inside the passage during the movement of the vane but also it makes it easier for a vane to enter a passage of a stator while another vane of the same wheel still cooperates with a passage of another stator.

The invention generally applies to the rotative machines of the type defined above.

It applies to machines whose rotor has an incurved surface to cooperate slidingly with the tops of the ribs bordering the passages of the stator.

It applies also to the rotative machines in which the surface of cooperation is a flat surface.

It applies not only to the machines in which the axis of the vane wheels are perpendicular to the axis of rotation but also to the machines in which the said axes, while being transverse to the axis of rotation, are not perpendicular to the latter.

What is claimed is:

1. A rotative machine for fluids comprising first and second stator plates with spiral-like passages, a rotor disc facing said stator plates mounted for rotation relative thereto on a common axis and carrying, on its face in front of the passages, vane wheels mounted for rotation on axes transverse to the said common axis whose vane circulate in the passages where they form fluid compartments completed by the cooperating surfaces of the stator and of the rotor covering the passages, characterized by the fact that the rotor has vane wheels cooperating, by their diametrally opposite parts, simultaneously with the passages of the first stator which extend between a first inlet chamber and a first outlet chamber and with the passages of the second stator which extend between a second inlet chamber and a second outlet chamber, the fluid passages connecting the first inlet and first outlet chambers of the first stator do not communicate with the fluid passages connecting the second inlet and second outlet chambers of the second stator, whereby the pressure exerted by fluid circulating in said machine against said vanes is in the same direction on each side of said rotor so that said vane wheels operate as thrust bearings in said rotor.

2. A machine as claimed in claim 1, wherein said first and second outlet chambers are connected to a common outlet of said machine.

3. A machine as claimed in claim 1, wherein in one stator the circulation of the vanes of the wheels is centrifugal and in the other stator it is centripetal.

4. A machine as claimed in claim 3, including means to compensate, by the outlet pressure, for the inequality of forces which are exerted on one and the other faces of the rotor and created by the circulation of the fluid in the passages of the first and the second stators.

5. A machine as claimed in claim 3, wherein the vanes of the vane wheels are made in several parts divided longitudinally with elastic means to move away, one from the other, the lateral sides of a vane.

6. A machine as claimed in claim 5, wherein said elastic means comprises a single circular spring member housed within each vane wheel.

* * * * *